United States Patent [19]

Eakman et al.

[11] Patent Number: 4,459,201

[45] Date of Patent: Jul. 10, 1984

[54] OIL SHALE RETORTING PROCESS UTILIZING INDIRECT HEAT TRANSFER

[75] Inventors: James M. Eakman, Friendswood; Frederick M. Gragg, Seabrook, both of Tex.

[73] Assignee: Exxon Research and Engineering Co., Florham Park, N.J.

[21] Appl. No.: 359,959

[22] Filed: Mar. 19, 1982

[51] Int. Cl.[3] ..... C10G 1/00; C10B 53/06

[52] U.S. Cl. ..... 208/11 R; 208/8 R

[58] Field of Search ..... 208/8 R, 11 R; 201/13, 201/14, 16; 422/146

[56] References Cited

U.S. PATENT DOCUMENTS

| | | | |
|---|---|---|---|
| 2,488,406 | 11/1949 | Hirsch | 422/146 X |
| 2,543,884 | 3/1951 | Weikart | 201/16 X |
| 2,655,437 | 10/1953 | Garbo | 422/146 X |
| 2,674,612 | 4/1954 | Murphree | 422/146 X |
| 2,701,787 | 2/1955 | Hemminger et al. | 208/11 R X |
| 2,725,347 | 11/1955 | Leffer | 208/11 R |
| 3,384,569 | 5/1968 | Peet | 208/11 R |
| 3,954,597 | 5/1976 | Morrell | 208/11 R |
| 4,064,018 | 12/1977 | Choi | 208/8 R X |
| 4,088,562 | 5/1978 | O'Ffill | 208/11 R |

OTHER PUBLICATIONS

Wigton, Henry Ford Harding, "Continuous Carbonization and Combustion of Oil Shale Using a Fluidized System, " Doctoral Thesis, University of Colorado, 1952.

Oil Shale Retorting Process and Apparatus, James M. Eakman, U.S. Ser. No. 336,739.

*Primary Examiner*—Delbert E. Gantz
*Assistant Examiner*—Glenn A. Caldarola
*Attorney, Agent, or Firm*—Yale S. Finkle; Wayne Hoover

[57] ABSTRACT

Carbon-containing solids such as oil shale or coal are pyrolyzed or retorted in an apparatus constructed in such a manner that the heat required for pyrolysis is supplied by burning residual organic material in the pyrolyzed solids in an external combustion zone and in an internal combustion zone that is situated with respect to the pyrolysis or retorting zone such that the heat of combustion is transferred through the walls of the internal combustion zone into the pyrolysis or retorting zone. The pyrolyzed solids are passed from the retorting zone to either the external combustion zone or the internal combustion zone wherein a portion of the organic material in the solids is burned. The partially burned solids exiting this zone are then passed to either the external combustion zone or the internal combustion zone where all or a portion of the remaining organic material is burned. The heat carried into the internal combustion zone with the hot solids produced by burning the organic material in the external combustion zone and the heat of combustion produced in the internal combustion zone are transferred through the walls of the internal combustion zone to supply substantially all or a major portion of the heat required to pyrolyze the carbon-containing feed solids in the retorting zone. None of the solids or flue gases produced in either the internal combustion zone or the external combustion zone are passed directly into the retorting zone.

13 Claims, 3 Drawing Figures

OIL SHALE RETORTING PROCESS UTILIZING INDIRECT HEAT TRANSFER

BACKGROUND OF THE INVENTION

This invention relates to the pyrolysis of solids containing organic material and is particularly concerned with a process and apparatus for retorting oil shale or coal in which the heat required for the retorting process is supplied indirectly to the retorting zone by burning the residual organic material left in the retorted shale or coal.

Because of a dwindling supply of petroleum liquids from underground reservoirs, attention has recently been focused on the recovery of hydrocarbon liquids and gases from solids such as oil shale, coal, industrial and municipal solid wastes and the like. Work by both governmental agencies and private industry has demonstrated that the organic material in such solids can be converted with varying degrees of difficulty into volatile hydrocarbonaceous fluids such as combustible gases, motor fuels, heating and fuel oils, and various by-products which have value in chemical and petrochemical industries. In general, the more attractive of the recovery techniques previously proposed involve the heat treatment of such solids in a manner sufficient to distill or otherwise decompose the organic material into the above-mentioned volatile hydrocarbonaceous products. Such techniques, which are commonly referred to as retorting or pyrolysis processes, take on a multitude of forms, including batch or continuous schemes utilizing fixed, moving or fluidized beds wherein either a portion of the solid organic material itself is combusted to supply the pyrolysis heat, or the pyrolysis heat is generated externally and supplied to the process via a gaseous, liquid or solid heat carrier.

Oil shale is considered to be one of the best candidates of all carbon-containing materials for processing in such a retorting or pyrolysis scheme since it comprises a mixture of a minor amount of solid organic matter called kerogen and a major amount of mineral matter. Because of the physical and chemical compositions of oil shale, its organic content has not been found to be economically recoverable by any technique other than the application of heat via pyrolysis or retorting. When mined oil shale is retorted, the solid organic matter undergoes destructive pyrolysis and a large percentage of the organic matter is converted to liquid and light gaseous hydrocarbonaceous products with the remainder staying as a carbon-rich residue in the mineral matrix. Processes for recovering hydrocarbonaceous products from raw oil shale are generally classified into four categories according to the method in which the heat is supplied. These categories are as follows: (1) heat is transferred from an external source through the walls of the retorting vessel; (2) heat is supplied by direct combustion in the retorting vessel; (3) heat is supplied by passing an externally heated gas into the retorting vessel; or (4) heat is supplied by introducing externally heated solids into the retorting apparatus. The known processes which fall in category (1) have a major disadvantage in that there is a substantial amount of organic matter left in the retorted oil shale and this in turn substantially decreases the economics of the overall process. The processes encompassed by category (2) in which combustion is carried out in the retort itself avoids the problem of not converting a substantial amount of the organic material present but have disadvantages in that the product is diluted by the combustion gases produced, the naphtha yields are lower because the light vapors burn and there is a tendency for the shale to overheat and form clinkers in the retort.

The indirectly heated retorting processes of categories (3) and (4) while having advantages over the processes in categories (1) and (2) still have major disadvantages. The use of an externally heated gas to supply heat enables the gas and solids residence times to be independently controlled and may result in greater than Fischer Assay yields. Unfortunately, such processes require high gas rates, result in a product diluted by the externally added gas, leave unconverted organic material in the retorted shale, and pose a high potential for solids carryover. The processes of category (4) in which the raw shale is contacted with externally heated solids, preferably produced by combusting spent shale produced in the retort, avoid dilution of the product gas but have disadvantages which include the requirement for additional expense of solids handling apparatuses and procedures, and a decrease in product yield caused by the adsorption of pyrolysis products on the heat carrier solids. Some of the processes which fall in categories (3) and (4) often yield a spent shale which contains as much as 30 percent of original feed carbon. This results in low thermal efficiency and poses potential waste disposal problems.

SUMMARY OF THE INVENTION

The present invention provides a process for the retorting or pyrolysis of oil shale, coal and similar carbon-containing solids which at least in part obviates the disadvantages of the processes referred to above. As used herein the phrase "carbon-containing solids" refers to any solids that contain organic material. In accordance with the invention, it has now been found that carbon-containing solids can be retorted or pyrolyzed without diluting the product and without introducing externally heated solids into the retorting or pyrolysis zone while at the same time obtaining a high conversion of the organic material contained in the solids. The carbon-containing solids are pyrolyzed in a fluidized bed retorting zone located inside a retorting vessel and situated in relation to a combustion zone also located in the same vessel such that heat generated in and introduced into the combustion zone can be transferred through its walls into the retorting zone to supply all or a majority of the heat required to carry out the pyrolysis. The carbon-containing feed solids are contacted with a fluidizing gas in the fluidized bed retorting zone under pyrolysis conditions to produce pyrolysis products and pyrolyzed carbon-containing solids. Liquid hydrocarbons are recovered from the pyrolysis products and the pyrolyzed solids are passed to an external combustion zone. Here the pyrolyzed solids are contacted with an oxygen-containing gas under conditions such that at least a portion of the residual organic material remaining in the solids is burned to produce hot combusted solids. These hot solids are then passed from the external combustion zone to the internal combustion zone where they are contacted with an oxygen containing gas under conditions such that at least a portion of any remaining organic material in the solids is burned to produce heat and this heat of combustion along with the sensible heat in the hot solids passed into the zone are transferred through the walls of the zone into the fluidized bed retorting zone thereby supplying the heat required to pyrolyze the carbon-containing feed solids. Substantially none of the combusted solids or the flue gas produced in either the external or internal combustion zones is passed into the retorting zone. Preferably, the fluidizing gas utilized in the retorting zone is a recycle gas recovered from the pyrolysis products.

Normally, the solids exiting the internal combustion zone are recycled to the external combustion zone where they are reheated and then passed back to the internal combustion zone thereby serving as a heat carrier. Preferably, both the external and internal combustion zones contain fluidized beds.

In an alternate embodiment of the invention, the pyrolyzed solids exiting the fluidized bed retorting zone are first passed into the internal combustion zone where only a portion of the organic material in the solids is burned to produce heat, the partially combusted solids are then passed to the external combustion zone where at least a portion of the remaining organic material is burned to produce hot solids and the resultant hot solids are returned to the internal combustion zone where their sensible heat and the heat of combustion generated in the zone are transferred through the walls of the internal combustion zone into the fluidized bed retorting zone to supply all or a major portion of the heat required to pyrolyze the carbon-containing feed solids. By utilizing both an internal and an external combustion zone to burn the organic material remaining in the pyrolyzed solids exiting the retorting zone, the velocity of the oxygen-containing gas which is introduced into the internal combustion zone can be controlled in such a manner to yield optimum heat transfer between the internal combustion zone and the retorting zone. In a system where only an internal combustion zone is utilized, the velocity of the oxygen-containing gas is set such that enough oxygen is present in the zone to burn the amount of organic material in the solids that is required to supply the heat for pyrolysis. The gas velocity set in this manner may not result in optimum heat transfer between the combustion zone and the retorting zone. The use of the external combustion zone in addition to the internal combustion zone overcomes this disadvantage by allowing the velocity of the oxygen-containing gas through the internal combustion zone to be set for optimum heat transfer because the portion of the organic material not burned in the internal combustion zone can be burned in the external combustion zone and the resultant heat passed with the hot solids produced therein to the internal combustion zone for transfer to the retorting zone.

The process of the invention provides many advantages over processes proposed in the past for retorting oil shale and other carbon-containing solids. Residual organic material in the retorted solids is utilized to provide the heat required for retorting in such a way that the flue gas or hot solids do not contact the pyrolysis products. Clinker formation is minimized by combustion of organic material in a relatively dilute phase fluid bed and by improved heat transfer afforded by fluidization. Optimum heat transfer to the retorting zone is obtained by adjusting the flow of oxygen-containing gas in the internal combustion zone and the flow of fluidizing gas in the retorting zone. Fines which are generated by the loss of structural and particle integrity in the combustion portion of the process are not mixed with pyrolysis products. The use of the process of the invention results in greater heat utilization and higher thermal efficiency than can be obtained by the use of other retorting processes now known.

DESCRIPTION OF THE PREFERRED EMBODIMENTS

Figures 1, 3:
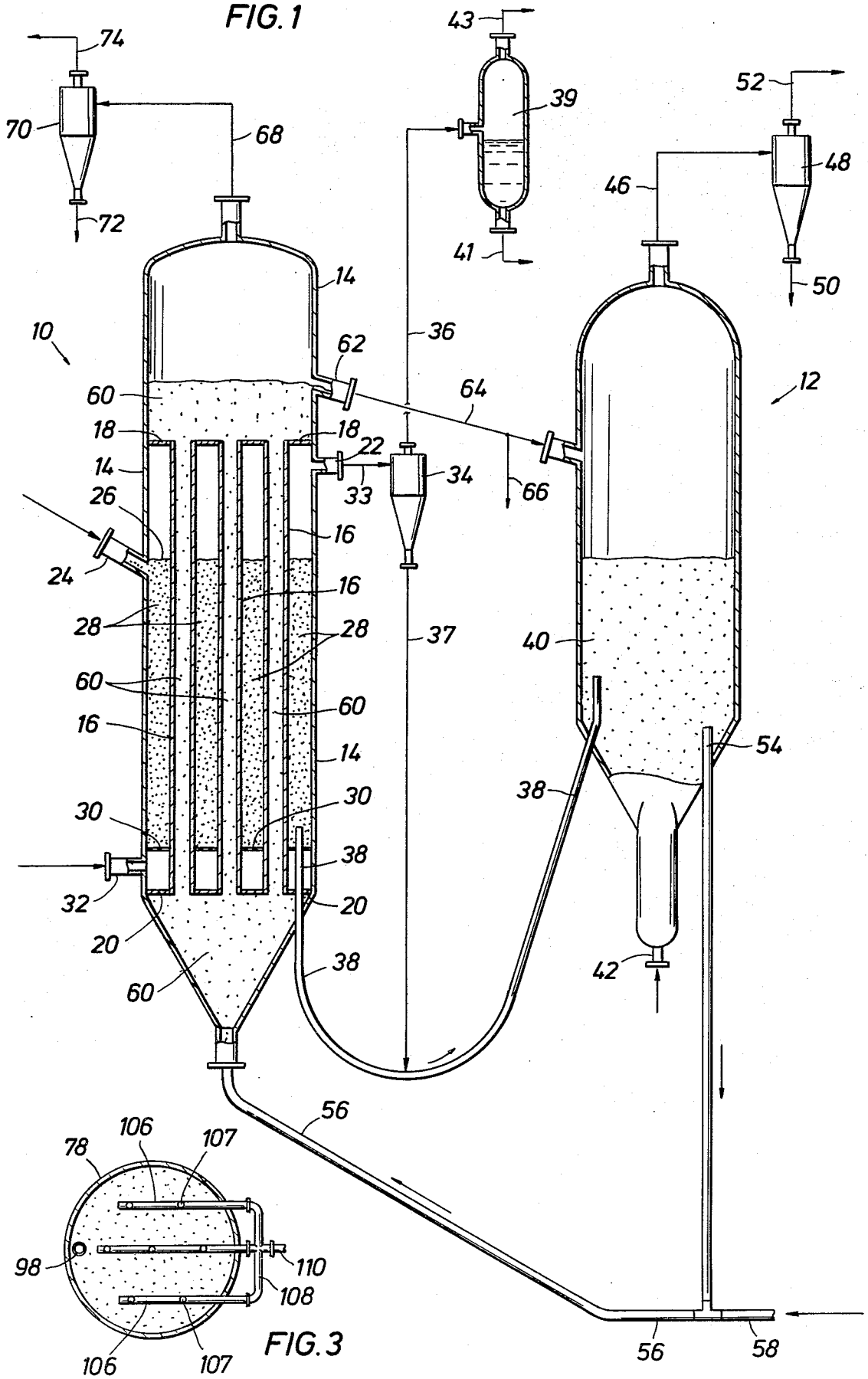
FIG. 1 in the drawing is a schematic flow diagram of one embodiment of the process of the invention in which a vertical sectional view of the retort is shown.
FIG. 3 is a horizontal cross-sectional view of the lower portion of the retort depicted in FIG. 2 taken on the line 3—3.
Figure 2:
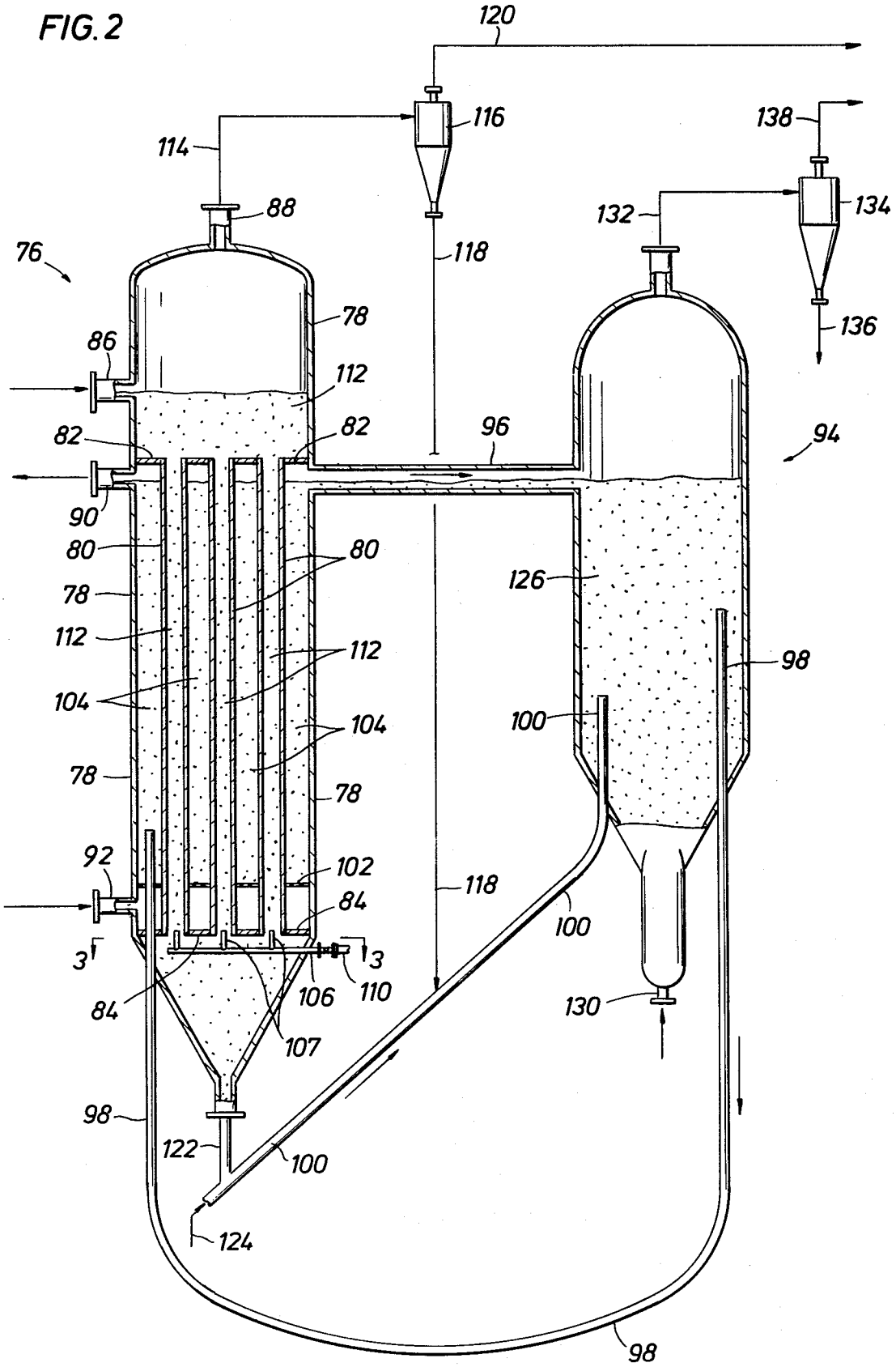
FIG. 2 is a schematic flow diagram of another embodiment of the process of the invention in which a vertical sectional view of the retort is shown.

The systems shown in FIGS. 1 through 3 are designed for retorting or pyrolyzing carbon-containing solids in accordance with the process of the invention in order to efficiently recover hydrocarbon gases and liquids. Although the systems are preferably used to process oil shale, it will be understood that they may also be used to retort or pyrolyze bituminous coal, subbituminous coal, lignitic coal, solid organic waste, liquefaction bottoms, petroleum coke, tar sands and other carbon-containing solids in accordance with the process of the invention.

The retorting system shown in FIG. 1 includes retort 10 and external combustor 12. Retort 10 includes a vertical vessel or shell 14 having a plurality of elongated, hollow tubular members or combustion tubes 16 suspended within the vessel between end plates 18 and 20. The combustion tubes, which are fabricated from heat conductive materials, are open at each end and the open ends of each tube extend through end plates 18 and 20, respectively. Nozzle 22, located near the top of the space external to the combustion tubes between end plates 18 and 20, serves as a means of removing the pyrolysis products produced in the retort. Nozzle 24, located near the middle of vessel 14, is used for introducing the carbon-containing feed material into the retort at a point near the top 26 of fluidized bed retorting zone 28.

The bottom portion of the retort 10 contains a distribution tray 30 located just above end plate 20. This device serves to distribute a fluidizing gas upwardly into fluidized bed retorting zone 28, which occupies a portion of the space inside of vessel 10 that is external to combusion tubes 16 and extends upward from distributor tray 30 to end plate 18. The fluidizing gas is introduced into the retort through nozzle 32. Distribution tray 30 is preferably a sieve tray but can also be a pipe distributor, a bubble cap tray, or similar distribution device.

When the system depicted in FIG. 1 is in operation, the carbon-containing feed solids are introduced through nozzle 24 into fluidized bed retorting zone 28 at a point near the top 26 of the zone. The carbon-containing solids pass downwardly through the fluidized bed in countercurrent contact with an upwardly flowing gas introduced into the retorting zone through nozzle 32 and distribution tray 30. This fluidizing gas serves to maintain the solids in a fluidized state and may be steam, an inert gas, a recycle pyrolysis gas obtained by processing the pyrolysis products removed from retort 10 and the like. Preferably, a recycle pyrolysis gas is utilized as the fluidizing gas.

As the carbon-containing solids flow downwardly through retorting zone 28, they are subjected to a temperature between about 700° F. and about 1400° F., preferably between about 900° F. and about 1000° F. Although any pressure may be utilized in the retorting zone, it is preferred to maintain the zone at atmospheric pressure. Under the conditions in the retorting zone, the organic material in the carbon-containing solids is decomposed and volatilized to produce pyrolysis products containing vaporous and gaseous hydrocarbons. These pyrolysis products are stripped from the solids by the fluidizing gas and pass upwardly with the gas from the top 26 of fluidized bed retorting zone 28 through the upper portion of retort 10 and out of the vessel 14 through nozzle 22. These pyrolysis products are then passed through line 33 to cyclone separator or similar device 34 where dust and other fine particulates are removed through dip leg 37. The vaporous and gaseous hydrocarbons from which the fines have been removed are withdrawn overhead from separator 34 through line 36 and passed to condenser 39 where the vapors are condensed. Liquid hydrocarbons are removed from condenser 39 through line 41 and passed to downstream units, not shown in the drawing, for upgrading. Gaseous hydrocarbons are removed from the condenser through line 43 and passed to downstream processing units, not shown in the drawing, where gases are recovered as products and for recycling to retort 10 through nozzle 32.

After the carbon-containing solids have undergone pyrolysis in retorting zone 28, they are mixed with the fine particulates in dip leg 37 and passed through transfer line 38 into fluidized bed 40 in external combustor 12. The fluidized bed 40 consists of hot solids which extend upward above nozzle 42. The pyrolyzed solids introduced into fluidized bed 40 are contacted and fluidized with an oxygen-containing gas which is introduced into the external combustor through bottom inlet nozzle 42. A sufficient amount of the oxygen-containing gas, which is preferably air is introduced into the external combustor such that at least a portion of the residual organic matter in the pyrolyzed solids fed to the combustor reacts exothermally with oxygen to form carbon dioxide, carbon monoxide, sulfur oxides, nitrogen oxides and combusted solids which comprise the majority of the fluidized bed. The temperature in the external combustor will be greater than the temperature in retorting zone 28 and will normally be maintained between about 900° F. and about 2000° F., preferably between about 1100° F. and about 1400° F. The pressure in the external combustor will be essentially the same as the pressure in retorting zone 28. The concentration of oxygen in the oxygen-containing gas will normally range between about 5 volume percent and about 25 volume percent. The combustion taking place within the combustor is normally controlled so that all of the organic material in the pyrolyzed feed solids is not burned away. A portion of the organic material is normally allowed to remain in the solids so that the carbon-containing solids produced in the combustor can be further burned in a combustion zone internal to retort 10.

The gas leaving fluidized bed 40 in external combustor 12 passes through the upper section of the combustor, which serves as a disengagement zone where particles too heavy to be entrained by the gas leaving the vessel are returned to the bed. If desired, this disengagement zone may include one or more cyclone separators or the like for the removal of relatively large particles from the gas. The gas withdrawn from the upper part of the combustor through line 46 will normally contain a mixture of carbon monoxide, carbon dioxide, sulfur oxides, nitrogen oxides, unreacted oxygen, nitrogen and entrained fines. This hot flue gas is introduced into cyclone separator or similar device 48 where the fine particulates are removed via line 50. The raw, hot flue gas from which the fines have been removed is withdrawn overhead from separator 48 through line 52. This hot flue gas can be passed to a waste heat boiler or other device where its heat can be utilized to generate steam for some other purpose, or it may be used to preheat the carbon-containing solids that are fed into retort 10 through nozzle 24 by passing the hot gas to a preheater where it is contacted directly with the incoming carbon-containing feed solids.

A portion of the heat generated in external combustor 12 by burning a portion of the organic material in the solids fed into the vessel through line 38 is absorbed by the solids in fluidized bed 40. This heat is utilized, in accordance with the invention, to supply a portion of the heat necessary to pyrolyze the carbon-containing feed solids introduced into retort 10 through nozzle 24. This is accomplished by passing the hot solids from external combustor 12 into the combustion tubes 16 in retort 10 so that the sensible heat in the solids can be transferred through the walls of the combustion tubes into retorting zone 28. The hot solids in fluidized bed 40 flow downward through standpipe 54 into transfer line 56 where they are entrained in an oxygen-containing gas, preferably air, introduced into the transfer line through line 58. The hot solids are carried with the oxygen-containing gas through transfer line 56 into the bottom of retort 10 where they are introduced into internal fluidized bed combustion zone 60 which extends from the bottom of retort 10 upward through combustion tubes 16 to nozzle 62, which is located near the top of the retort.

In the fluidized bed in internal combustion zone 60, the organic material remaining in the solids fed to the retort through line 56 reacts with the oxygen in the fluidizing gas to produce carbon monoxide, carbon dioxide, sulfur oxides, nitrogen oxides and large quantities of heat. The heat generated in the combustion zone and the sensible heat carried into the combustion zone with the solids from external combustor 12 are transferred through the walls of combustion tubes 16 into retorting zone 28 to supply substantially all or a major portion of the heat required in the retorting zone to pyrolyze the carbon-containing feed solids. Normally, the only other source of pyrolysis heat is the heat in the fluidizing gas introduced into the retorting zone through nozzle 32 and distribution tray 30. In some cases, however, it may be desirable to supply additional heat into the retorting zone by burning a supplementary fuel, such as a fuel gas, in external combustor 12, internal combustion zone 60, or in both. The temperature in internal combustion zone 60 is normally maintained at a level substantially higher than the temperature in retorting zone 28 and normally ranges between about 900° F. and about 2000° F., preferably between about 1100° F. and about 1400° F. The pressure in combustion zone 60 will be essentially the same as the pressure in retorting zone 28. The concentration of the oxygen in the oxygen-containing gas introduced into the retort through lines 58 and 56 will normally range between about 5 volume percent and about 25 volume percent.

As the carbon-containing feed solids pass downwardly from inlet nozzle 24 through fluidized bed retorting zone 28, they are heated to increasingly higher temperatures by countercurrent heat transfer from the hot gases and solids which flow upwardly through combustion tubes 16. This countercurrent heat transfer is a highly thermodynamically reversible process and results in greater heat utilization and higher thermal efficiencies than are possible with other methods of heat input. The optimum heat transfer from the portion of the internal combustion zone contained within combustion tubes 16 through the walls of the tubes into retorting zone 28 can be obtained only by varying the velocities of the gases flowing through the internal combustion zone and through the retorting zone in accordance with conventional heat transfer calculations. It has been found that the use of an external combustion zone in addition to the internal combustion zone will allow flexibility in selecting the amount and therefore the velocity of the oxygen-containing gas that flows through the internal combustion zone. Thus use of an external combustion zone allows optimum heat transfer to be obtained between the internal combustion zone and the retorting zone to efficiently supply the heat necessary to pyrolyze the raw carbon-containing feed solids without the need to supply external heat to the retorting zone in the form of added hot solids or hot gases.

Referring again to FIG. 1, the number of combustion tubes 16 utilized in retort 10 will depend upon the amount of heat required to be transferred from the internal combustion zone 60 into retorting zone 28. The greater the number of combustion tubes utilized, the greater the area of heat transfer available and the more heat that can be provided to the retorting zone for pyrolysis of the carbon-containing feed solids. Also, a greater number of combustion tubes can be used to minimize circulation and mixing so that the carbon-containing feed solids and fluidizing gas introduced into the retorting zone flow countercurrently to each other in a relatively plug flow manner.

The spent solids exiting the top of combustion tubes 16 will have given up a substantial amount of their heat content through the walls of the tubes into retorting zone 28 and will be relatively cool. These cool solids are removed from the upper portion of the retort through nozzle 62 and passed through line 64 into the upper portion of external combustor 12 at a point above fluidized bed 40. In order to maintain a desired bed level in external combustor 12, a portion of these spent solids are removed from the entire system as a purge through line 66. The relatively cool, spent solids that are introduced into external combustor 12 are continually circulated between the combustor and internal combustion zone 60 in retort 10 until they are purged from the system through line 66. The continuous circulation of these spent solids allows the temperature in external combustor 12 to be maintained at a level such that high temperature alloys are not needed for vessel construction and undesirable high temperature mineral reactions do not take place. The cool, spent solids entering the combustor through line 64 absorb a portion of the heat generated in the combustor thereby maintaining the temperature at a relatively low level, preferably between about 1100° F. and about 1400° F. The temperature in the combustor can be lowered by increasing the circulation rate of the spent solids.

The gas leaving the fluidized bed in internal combustion zone 60 passes through the upper section of retort 10, which serves as a disengagement zone where particles too heavy to be entrained by the gas leaving the vessel are returned to the bed. If desired, this disengagement zone may include one or more cyclone separators or the like for the removal of relatively large particles from the gas. The gas withdrawn from the upper part of the retort through line 68 will normally contain a mixture of carbon monoxide, carbon dioxide, sulfur oxides, nitrogen oxides, unreacted oxygen, nitrogen and entrained fines. This hot flue gas is introduced into cyclone separator 70 where the fine particulates are removed through line 72. The raw, hot flue gas from which the fines have been removed is withdrawn overhead from separator 70 through line 74 and can be passed to a waste heat boiler or other device where its heat can be utilized to generate steam or for some other purpose. Alternatively this flue gas can be used to preheat the carbon-containing solids fed to retort 10.

It will be understood that the process of the invention can be carried out in an apparatus which differs from that shown in FIG. 1 as long as the internal combustion zone is situated with respect to the retorting or pyrolysis zone in such a manner that the sensible heat in the combusted solids passed to the internal combustion zone from the external combustion zone and the heat of combustion generated in the internal combustion zone can be transferred through the walls of the internal combustion zone to the retorting or pyrolysis zone. In the embodiment of the invention depicted in FIGS. 2 and 3, the retorting and internal combustion zones are reversed. Thus, the tubes that contain a portion of the internal combustion zone in the apparatus of FIG. 1 contain the retorting zone in the apparatus of FIGS. 2 and 3. Similarly, the space external to combustion tubes 16 and encompassed by the walls of vessel 14 that contains the retorting zone in the apparatus shown in FIG. 1 contains the internal combustion zone in the apparatus depicted in FIGS. 2 and 3.

Referring specifically to FIGS. 2 and 3, retort 76 is comprised of vertical vessel 78 and a plurality of open-ended pyrolysis tubes 80 mounted inside vessel 78 between end plates 82 and 84. Vessel 78 contains nozzle 86 for the introduction into the retort of the carbon-containing feed solids, nozzle 88 for withdrawing the pyrolysis products, nozzle 90 for withdrawing spent burned solids and nozzle 92 for introducing an oxygen-containing gas into the retort. Retort 76 communicates with external combustor 94 via connecting line 96, loop transfer line 98 and lift pipe 100.

The bottom of retort 76 contains distribution tray 102 for the introduction of the oxygen-containing gas into fluidized bed internal combustion zone 104, which comprises the space inside the retort encompassed by the walls of vessel 78 and extending upward from distribution tray 102 to connecting line 96. Also located at the bottom of retort 76 are gas distribution pipes 106. As shown in FIG. 3, these pipes enter vessel 78 from manifold 108 and line 110. Each distribution pipe 106 contains a sufficient number of nozzles 107 such that the bottom of each pyrolysis tube 80 has a nozzle extending vertically into it from a distribution pipe. The distribution pipes and nozzles serve to introduce a fluidizing gas into fluidized bed retorting zone 112, which is partially contained within the pyrolysis tubes 80.

When the embodiment of the invention depicted in FIGS. 2 and 3 is in operation, the carbon-containing feed solids are introduced into the top of retort 76 through nozzle 86 and passed into fluidized bed retorting zone 112, which extends downwardly into each pyrolysis tube 80. The carbon-containing solids flow downwardly through the pyrolysis tubes in contact with a fluidizing gas passed upwardly into the bottom of each pyrolysis tube 80 through nozzles 107 and distribution pipes 106. The fluidizing gas may be steam, an inert gas, a recycle pyrolysis gas obtained by processing the pyrolysis products exiting retort 76 through nozzle 88 or the like. As the solids flow downward through the pyrolysis tubes, they are subjected to a temperature between about 700° F. and about 1400° F., preferably between about 900° F. and about 1000° F. Normally, the pressure in the pyrolysis tubes is maintained at or near atmospheric pressure. Under such conditions, the organic material in the carbon-containing solids is decomposed and volatilized to form hydrocarbon gases and vapors that flow upwardly through the pyrolysis tubes toward the top of fluidized bed retorting zone 112.

The hydrocarbon vapors and gases that leave the fluidized bed in retorting zone 112 pass through the upper section of the retort, which serves as the disengagement zone where particles too heavy to be entrained by the vapor and gases leaving the vessel are returned to the bed. If desired, this disengagement zone may include one or more cyclone separators or the like for the removal of relatively large particles from the vapors and gases. The vapors and gases are withdrawn from the upper part of the retort through line 114 and passed to cyclone separator or similar device 116 where dust and other fine particulates are removed through dip leg 118. The hydrocarbon vapors and gases from which the fines have been removed are withdrawn overhead from separator 116 through line 120 and passed to downstream processing units, not shown in the drawing, for the recovery of liquid and gaseous hydrocarbon products.

The pyrolyzed solids flowing downwardly through pyrolysis tubes 80 exit the tubes and continue to pass downwardly around nozzles 107 and pipes 106 and out of the retort through line 122. The pyrolyzed solids pass from line 122 into lift pipe 100 where they are entrained in steam or another inert gas introduced into the lift pipe through line 124. The inert gas and pyrolyzed solids are then mixed with fine particulates of pyrolyzed solids introduced into lift pipe 100 through dip leg 118 and the resultant mixture of solids entrained in the gas is passed into fluidized bed 126 of hot solids extending upward within external combustor 94 above nozzle 130. The pyrolyzed solids introduced into fluidized bed 126 are maintained in a fluidized state within the external combustor by means of an oxygen-containing gas, preferably air, introduced into the combustor through bottom inlet nozzle 130. The oxygen in the gas introduced into the bottom of the combustor reacts with at least a portion of the residual organic material in the pyrolyzed solids fed to the combustor through lift pipe 100 to form carbon dioxide, carbon monoxide, sulfur oxides, nitrogen oxides, combusted solids, which comprise the majority of the fluidized bed, and a substantial amount of heat. The temperature in the combustor is maintained at a level higher than the temperature in retorting zone 112 and will normally range between about 900° F. and 2000° F., preferably between about 1100° F. and 1400° F. The pressure in the external combustor is essentially the same as the pressure in retorting zone 112. The combustion which takes place in fluidized bed 126 is normally controlled so that all of the organic material in the pyrolyzed solids fed to the external combustor is not burned away. A portion of the organic material is normally allowed to remain so that the particles produced in the combustor can be further burned in internal combustion zone 104.

The flue gas leaving the fluidized bed in external combustor 94 passes through the upper section of the combustor through a disengagement zone, which may include one or more cyclone separators or the like, for removal of relatively large particles from the gas. The gas withdrawn from the upper part of the combustor through line 132 will normally contain a mixture of carbon monoxide, carbon dioxide, sulfur oxides, nitrogen oxides, unreacted oxygen, nitrogen and entrained fines. This hot flue gas is introduced into cyclone separator or similar device 134 where the fine particulates are removed and withdrawn through line 136. Hot flue gas from which the fines have been removed is withdrawn overhead from the separator through line 138 and can be passed to downstream processing units for recovery of its heat content.

The heat of combustion produced in external combustor 94 by burning the organic material in the particles fed into the external combustor through lift pipe 100 is absorbed by the solids in fluidized bed 126. These hot solids, which include partially burned particles containing residual organic material, are passed from fluidized bed 126 through loop transfer line 98 into the fluidized bed of solids in internal combustion zone 104, which extends upward above distribution tray 102 in retort 76. The solids are maintained in the fluidized state within internal combustion zone 104 by an oxygen-containing gas, preferably air, introduced into the combustion zone through nozzle 92 and distribution tray 102.

As the hot particles pass upward from loop transfer line 98 through internal combustion zone 104, the organic material remaining in the partially burned particles reacts with oxygen in the oxygen-containing gas to produce carbon monoxide, carbon dioxide, sulfur oxides, nitrogen oxides and additional quantities of heat. The heat thus generated along with the sensible heat in the hot particles introduced in the zone through loop transfer line 98 are transferred through the outer walls of each pyrolysis tube 80 into retorting zone 112 to supply substantially all or a major portion of the heat required to pyrolyze the carbon-containing solids that are introduced into the retort through nozzle 86. Normally, the temperature in the internal combustion zone will be maintained between about 900° F. and about 2000° F., preferably between about 1100° F. and about 1400° F. The pressure in the combustion zone will be essentially the same as the pressure in retorting zone 112.

In the embodiments of the invention described above and depicted in FIGS. 1 and 2, the heat of pyrolysis is supplied by burning at least a portion of the organic material remaining in the pyrolyzed, carbon-containing feed solids. This heat is obtained by burning the residual organic material in both an external combustion zone and an internal combustion zone and the heat is supplied to the retorting zone indirectly through the walls of the internal combustion zone so that it is not necessary to pass hot combusted solids or flue gases directly into the retorting zone. The use of an external combustion zone in addition to the internal combustion zone yields substantial advantages over retorting systems which utilize only an internal combustion zone to supply indirect heat to the retorting zone. In the latter system, the amount of oxygen-containing gas supplied to the internal combustion zone is set by the amount of heat required for the pyrolysis and therefore the velocity of the oxygen-containing gas through the internal combustion zone is set to supply this required heat. This predetermined velocity, however, may have a deleterious effect on the heat transfer taking place between the internal combustion zone and the retorting zone. Ordinarily, it is desirable to set the velocities of the gases in the combustion zone and the retorting zone to obtain optimum heat transfer. The use of an external combustion zone in addition to the internal combustion zone allows the velocity of the oxygen-containing gas in the internal combustion zone to be set such that optimum heat transfer can be obtained. Any additional heat that ordinarily would have to be supplied by burning the residual organic material in the internal combustion zone can be supplied by burning the organic material in the external combustion zone and passing the resultant hot solids into the internal combustion zone where their sensible heat can be transferred to the retorting zone.

Referring again to FIG. 2, the amount of the oxygen-containing gas introduced into internal combustion zone 104 through nozzle 92 and distribution tray 102 is controlled in order to obtain optimum heat transfer between combustion zone 104 and retorting zone 112. The amount of oxygen-containing gas introduced into external combustor 94 through bottom inlet 130 is determined by the amount of heat that must be generated in external combustor 94 to supply the additional heat required in internal combustion zone 104 to supply the heat requirements of retorting zone 112. If the amount of heat generated in both external combustor 94 and internal combustion zone 104 is insufficient to supply all of the heat required for pyrolysis, a supplementary gaseous or solid fuel may be added directly to the combustor to generate the additional heat required. This fuel may be a fuel gas, coal, coal liquefaction bottoms, or similar solid carbonaceous materials.

The relatively cool, spent solids exiting the top of internal combustion zone 104 are passed with the flue gas generated in the combustion zone through connecting line 96 into external combustor 94. A portion of these spent solids is purged from retort 76 through nozzle 90 in order to keep them from building up within the system. When the cool, spent solids enter fluidized bed 126 in external combustor 94, they absorb a portion of the heat generated therein and can therefore be used to control the temperature in the external combustor. As the circulation rate of the spent solids is increased, the temperature in the combustor will decrease.

In the embodiments of the invention described above and depicted in the figures, the pyrolyzed, carbon-containing solids exiting the retorting zone are first passed to an external combustion zone where a portion of their residual organic material is burned and the resultant hot, partially burned or combusted solids are passed to an internal combustion zone where all or a portion of the remaining organic material is burned. The heat generated in both zones is indirectly transferred from the internal combustion zone into the retorting zone. It will be understood that the invention is not limited to the situation in which the pyrolyzed, carbon-containing solids are passed into the external combustion zone first, but is equally applicable to the case where the pyrolyzed solids are first passed to the internal combustion zone and the resultant partially burned solids are then passed to the external combustion zone. If it is desired to practice such a procedure, the embodiment of the invention depicted in FIG. 2 may be altered by eliminating lift pipe 100 and allowing the pyrolyzed solids exiting retort 76 through line 122 to pass directly into loop transfer line 98. This alteration in the system depicted in FIG. 2 will allow the pyrolyzed solids to flow directly with solids from external combustor 94 into internal combustion zone 104 where a portion of the residual organic material in them will be burned. The partially combusted or burned solids will then exit internal combustion zone 104 through connecting line 96 and pass to external combustor 94 where all or a portion of the remaining organic material is burned. In this embodiment of the invention the solids in the internal combustion zone will be rich in organic material and the maximum amount of heat will therefore be generated in the internal combustion zone where the fluidizing rate of oxygen-containing gas is set to obtain optimum heat transfer to the retorting zone. The external combustor can then be operated in any way desired without fear of burning too much organic material.

It will be apparent from the foregoing that the invention provides a method in which carbon-containing solids are pyrolyzed or retorted in such a manner that the heat of pyrolysis is supplied by burning the pyrolyzed solids in two combustion zones and the heat of combustion is indirectly transferred through the walls of one of the combustion zones into the retorting zone. As a result, it is not necessary to supply the heat required for pyrolysis by passing externally heated gases or solids directly into the retorting zone and it is possible to optimize heat transfer to the retorting zone by controlling the velocity of oxidizing gases in the combustion zone through whose walls the heat is transferred to the retorting zone.

We claim:

1. A process for the fluid bed retorting of carbon-containing solids to produce liquid hydrocarbons in a retort containing a fluidized bed retorting zone and an internal combustion zone which comprises:

(a) contacting said carbon-containing solids with a fluidizing gas in said fluidized bed retorting zone under pyrolysis conditions to produce pyrolysis products and pyrolyzed carbon-containing solids;

(b) recovering liquid hydrocarbons from said pyrolysis products;

(c) passing said pyrolyzed carbon-containing solids to a combustion zone external to said retort;

(d) contacting said pyrolyzed carbon-containing solids with a first stream of oxygen-containing gas in said external combustion zone under conditions such that at least a portion of the organic material remaining in said solids is burned to produce hot combusted solids;

(e) passing said hot combusted solids from said external combustion zone to said internal combustion zone wherein a supplemental fuel is introduced into said external combustion zone and burned to supply additional heat to the solids; and (f) contacting said hot combusted solids with a second stream of oxygen-containing gas separate from said first stream of oxygen-containing gas in said internal combustion zone under conditions such that at least a portion of any remaining organic material in said solids is burned to produce combustion heat and spent solids, wherein said combustion heat and the sensible heat in said hot combusted solids and said spent solids are transferred through the walls of said internal combustion zone into said fluidized bed retorting zone thereby supplying at least a major portion of the heat required to pyrolyze said carbon-containing solids in said retorting zone and wherein substantially none of the combusted solids, spent solids or flue gas produced in said internal or said external combustion zones is passed into said retorting zone, whereby said second stream of oxygen-containing gas is introduced into said internal combustion zone at a rate such that the velocity of said oxygen-containing gas through said internal combustion zone is set to obtain optimum heat transfer through the walls of said internal combustion zone into said retorting zone.

2. A process for the fluid bed retorting of carbon-containing solids to produce liquid hydrocarbons in a retort containing a fluidized bed retorting zone and an internal combustion zone which comprises:

(a) contacting said carbon-containing solids with a fluidizing gas in said fluidized bed retorting zone under pyrolysis conditions to produce pyrolysis products and pyrolyzed carbon-containing solids;

(b) recovering liquid hydrocarbons from said pyrolysis products;

(c) passing said pyrolyzed carbon-containing solids to said internal combustion zone wherein said solids are contacted with a first stream of oxygen-containing gas under conditions such that only a portion of the organic material remaining in said solids is burned to produce combustion heat and partially combusted solids;

(d) passing said partially combusted solids from said internal combustion zone to an external combustion zone wherein said partially combusted solids are contacted with a second stream of oxygen-containing gas separate from said first stream of oxygen-containing gas under conditions such that at least a portion of the remaining organic material in said solids is burned to produce hot spent solids; and (e) passing said hot spent solids from said external combustion zone to said internal combustion zone wherein the combustion heat produced in said internal combustion zone and the sensible heat in said hot spent solids and said partially combusted solids are transferred through the walls of said internal combustion zone into said fluidized bed retorting zone thereby supplying at least a major portion of the heat required to pyrolyze said carbon-containing solids in said retorting zone and wherein substantially none of the partially combusted solids, spent solids or flue gas produced in said internal or said external combustion zones is passed into said retorting zone, whereby said first stream of oxygen-containing gas can be introduced into said internal combustion zone at a rate such that the velocity of said oxygen-containing gas through said internal combustion zone is set to obtain optimum heat transfer through the walls of said internal combustion zone into said retorting zone.

3. A process as defined by claims 1 or 2 wherein said carbon-containing solids comprise coal.

4. A process as defined by claims 1 or 2 wherein said carbon-containing solids comprise oil shale.

5. A process as defined by claims 1 or 2 wherein said fluidizing gas comprises a recycle gas recovered from said pyrolysis products.

6. A process as defined by claims 1 or 2 wherein said internal combustion zone comprises a plurality of tubes disposed entirely within said retorting zone.

7. A process as defined by claims 1 or 2 wherein said retorting zone comprises a plurality of tubes disposed entirely within said internal combustion zone.

8. A process as defined by claims 1 or 2 wherein the heat generated in both said internal and said external combustion zones is sufficient to supply substantially all of the heat required in said retorting zone.

9. A process as defined by claim 2, wherein a supplemental fuel is introduced into said external zone and burned to supply additional heat to the solids.

10. A process as defined by claims 1 or 2 wherein said first and second streams of oxygen-containing gas comprise air.

11. A process as defined by claims 1 or 2 wherein the oxygen-containing gas introduced into said internal combustion zone and the fluidizing gas introduced into said retorting zone are introduced at such rates as to optimize the heat transfer through the walls of said internal combustion zone into said fluidized bed retorting zone.

12. A process as defined by claim 1 wherein a portion of said spent solids produced in said internal combustion zone is passed to said external combustion zone.

13. A process as defined by claims 1 or 2 wherein said internal combustion zone and said external combustion zones comprise fluizided bed combustion zones.

* * * * *